United States Patent [19]

Andrews et al.

[11] Patent Number: 4,646,931

[45] Date of Patent: Mar. 3, 1987

[54] REINFORCED OPEN HEAD DRUM LID

[76] Inventors: Joseph J. Andrews; Albert J. Andrews, both of 62 Allendale Rd., Philadelphia, Pa. 19151

[21] Appl. No.: 778,364

[22] Filed: Sep. 20, 1985

[51] Int. Cl.[4] ..... B65D 45/32

[52] U.S. Cl. ..... 220/320

[58] Field of Search ..... 220/319, 320, 321; 292/256.6, 256.61, 256.63, 256.65, 256.67, 256.69

[56] References Cited

U.S. PATENT DOCUMENTS 2,237,952 4/1941 Smith ..... 220/321

2,915,330 12/1959 Verliar ..... 220/320

*Primary Examiner*—George T. Hall

*Attorney, Agent, or Firm*—Ratner & Prestia

[57] ABSTRACT

A drum lid for an open head drum in which the drum lid is clamped to the drum by a closing ring for sealing the drum. A section of the lip of the lid is reinforced. The section is reinforced by rigidly securing a reinforcing member to the exterior of the lid. The reinforcing member may be a metal lug.

4 Claims, 14 Drawing Figures

REINFORCED OPEN HEAD DRUM LID

BACKGROUND OF THE INVENTION

A. Field of the Invention

This invention relates to the field of sealing open head drums and in particular to a lid for open head drums adapted to prevent leakage.

B. Background Art

Open head drums are commonly used in the shipment of all types of commodities. They are used the packaging of dry powders, paste, semi-solids, paints, viscous liquids and special applications. The success of open head drums has in part been due to the convenience of closing rings. After a gasket and a lid have been placed on the drum, a closing ring is conventionally placed over the lip of the lid and tightened by a bolt which draws projections on the ends of the closing ring closer together. This permits a very tight seal of the lid.

However, as the bolt is turned to draw the projections closer to each other, circular stress is placed on the rim of the lid. The major region of the lip rim is underneath the closing gasket and therefore cannot be compressed. However, the region of the lip between the projections of the closing ring may be forced to compress. This may cause a distortion or dimpling of the lid. It is at this dimple that most leakage may occur. This is very undesirable, especially when the drums are used for long-term storage of toxic waste.

Open head drums sealed with closing rings are tested for leak resistance by dropping them, filled to a predetermined substance weight, from a predetermined distance. The drums are dropped directly on the region of the projections of the closing rings. This causes the compressed region of the lip to get worse and may permit leakage.

SUMMARY OF THE INVENTION

A drum lid for an open head drum in which the drum lid is clamped to the drum by a closing ring for sealing the drum. A section of the lip of the lid is reinforced. The section is reinforced by rigidly securing a reinforcing member to the exterior of the lid. The reinforcing member may be a metal lug.

DETAILED DESCRIPTION OF THE INVENTION

Figure 1:
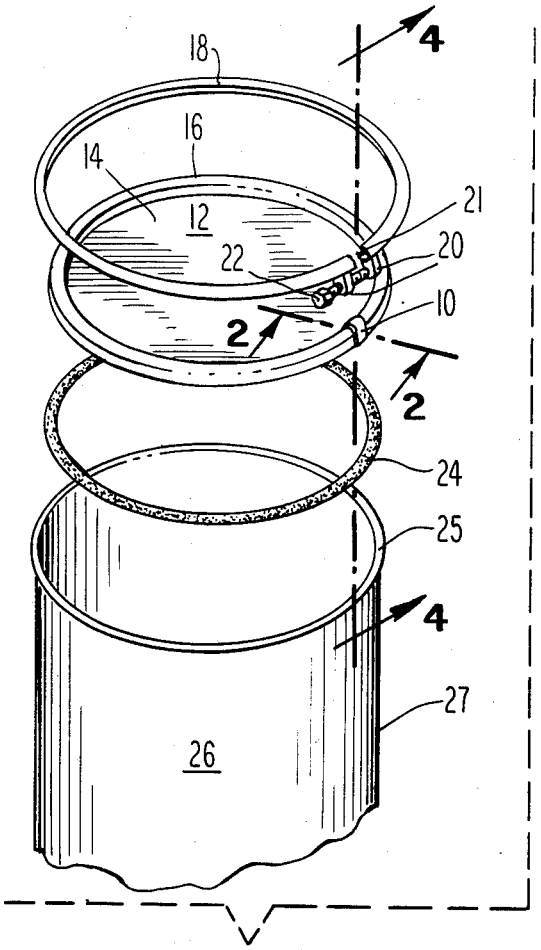
FIG. 1 illustrates a drum cover closure mechanism including the reinforced lip of the drum lid of the present invention.

Referring now to FIG. 1, there is shown open head drum 26 and the structures required to seal open head drum 26 including reinforcing member or lug 10 of the present invention. These include lid 12, annular gasket 24 which is disposed between lip 16 of lid 12 and rim 25 of drum 26, and closing ring 18. Closing ring 18 includes projections or fittings 20 disposed at opposing ends of closing ring 18 and bolt 22 which draws projections 20 toward each other when bolt 22 is turned thereby tightening closing ring 18 and sealing drum 26. Reinforcing lug 10 prevents distortion of lip 16 in the vicinity of projections 20 when closing ring 18 is tightened to seal drum 26.

Figure 2:
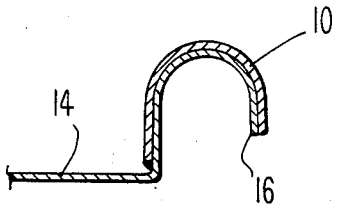
FIG. 2 illustrates a cross-sectional view of the reinforced section of the lid of FIG. 1.
Figure 3:
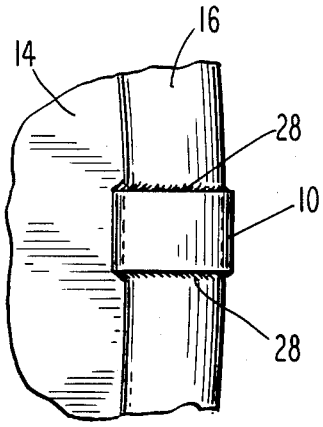
FIG. 3 shows a top view of the reinforced section of the lid of FIG. 2.

Referring now to FIGS. 2,3 there is shown a cross section through lid 12 and lug 10 which is secured over a section of lip 16 to reinforce a section of drum and a top view of lug 10. Around the perimeter of central flat body portion 14 of lid 12 is lip or bead 16. Lug or member 10 is welded to lip 16 at welding seams 28. The thickness of reinforcing lug 10 may preferably be equal to or less than the thickness of lip 16. For example reinforcing lug 10 may be twelve gauge and lip 16 may be twelve to sixteen gauge. However lug 10 may be any thickness determined to be sufficient to prevent dimpling of lid 12. The width of reinforcing lug 12 may be approximately one-half inch.

Figure 4:
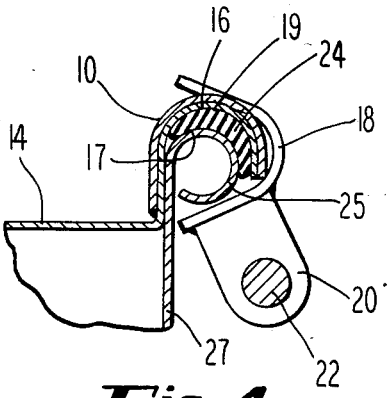
FIG. 4 shows a cross-sectional view of the reinforced section of the lid of FIG. 1 and a closing ring.

Referring now to FIG. 4, a cross section of the elements of FIG. 1 after assembly is shown. Drum rim 25, extending upwardly from side wall 27 of drum 26, engages concave face 17 of gasket 24. Convex face 19 of gasket 24 engages the concave face of lip 16 of lid 12. Gasket 24 is a conventional annular gasket, typically one-half square inch to one square inch. Lug 10 is secured to the outer surface of lip 16, as previously described.

Figure 5:
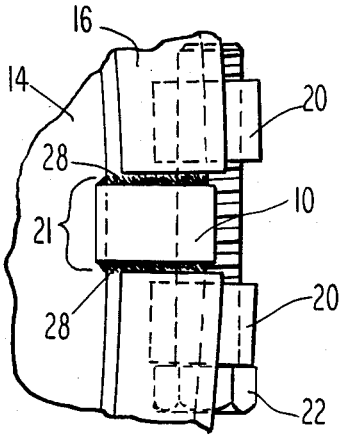
FIG. 5 illustrates a top view of the reinforced section of the lid and the closing ring of FIG. 4. FIGS. **6–6*h* show alternate embodiments of a reinforcing lug for the lid of FIG. 1**.

Referring now to FIG. 5, space 21 between the ends of closing ring 16 is positioned over lug 10 when placing closing ring 21 over lid 12. As bolt 22 is tightened, fittings 20 are drawn closer together, thereby drawing the ends of closing ring 18 closer together and decreasing the size of space 21 between the ends of closing ring 18. If the ends of closing ring 18 are drawn together closely enough, the ends of ring 18 may ride across welding seams 28 which secure lug 10 to lip 16. The ends of ring 18 may thus come to rest above lug 10, whereby portions of lug 10 or lug 10 in its entirety may be disposed below the ends of ring 18.

As bolt 22 is tightened and fittings 20 are drawn towards each other, a circular stress is placed on lip 16 of lid 12. Because the major portion of lip 16 under closing ring 21 may not yield to this stress, this stress is placed disproportionately upon the portion of lip 16 which lies below space 21. Without lug 10, this may cause the portion of lip 16 under space 21 to dimple creating the possibility that a substance within drum 26 may leak through such a dimple. Reinforcing lug 10, rigidly secured to lip 16, prevents such a dimple from forming if lug 10 is positioned below space 21 or beneath the ends of ring 16 after ring 16 is tightened.

Figure 6:
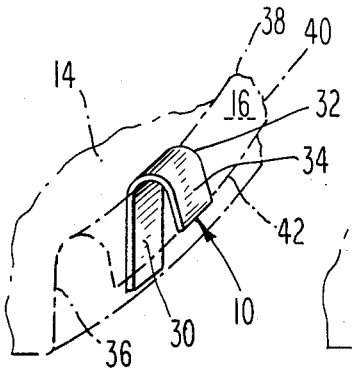

Referring now to FIG. 6, there is shown reinforcing lug 10 of FIGS. 1–5 and, in phantom, a section of central flat body portion 14 and lid lip 16. For clarity, welding seams 28 are not shown. Inner band 30 of lug 10 is positioned flush with wall 36 of lip 16. U-shaped arch curvature 32 of reinforcing lug 10 receives arcuate edge 38 of lip 16. Outer band 34 of reinforcing lug 10 extends downwardly over outer rim 40 of lip 16. Inner band 30 is welded to wall 36, arch curvature 32 of lug 10 is welded to arcuate edge 38, and outer band 34 is welded to outer rim 40. Thus a minor section of lip 16 is rigidly secured to and reinforced with lug 10 to prevent dimpling in that minor section.

While inner band 30 of lug 10 extends downwardly along the entire length of wall 36, terminating substantially close to central flat body portion 14 of lid 12 in the preferred embodiment, in alternate embodiments (not shown) inner band 30 may extend downwardly only a portion of the distance to flat body portion 14. For example, inner band 30 may extend one-half or three-quarters of the distance downward from arcuate edge 38 to flat body portion 14. Similarly, outer band 34 of lug 10 in its preferred embodiment, extends downwardly along the entire length of outer rim 40 to edge 42. However, outer band 34 may be formed to extend only a portion of the distance along outer rim 40 of lip 16 to edge 42. Furthermore, outer band 34 may extend downward beyond edge 42.

Figure 6A:
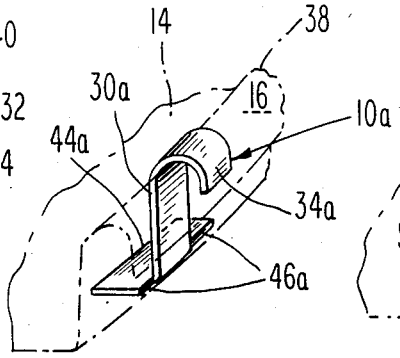

Referring now to FIGS. 6*a–h*, there are shown a plurality of alternate embodiments of reinforcing lug 10. For clarity, welding seams 28 are not shown. However it is understood that the alternate embodiments of lug 10 are rigidly secured to lip 16 by welding or other conventional means. As shown in FIG. 6*a*, reinforcing lug 10*a* may include horizontal flap 44*a* which may be welded to central flat body portion 14. Horizontal flap 44*a* may include rectangular extensions 46*a* extending outwardly beyond the width of inner band 30*a*. Alternately, extensions 46*a* may be omitted. Horizontal flap 44*a* may be included in any one of a plurality of embodiments of lug 10*a* having outer bands 34*a* of varying lengths. For example, horizontal flap 44*a* may be present when outer band 34*a* extends a portion of the distance from arcuate edge 38 to edge 42, the entire distance along outer rim 40, or when outer band 34*a* extends beyond edge 42.

Figure 6B:
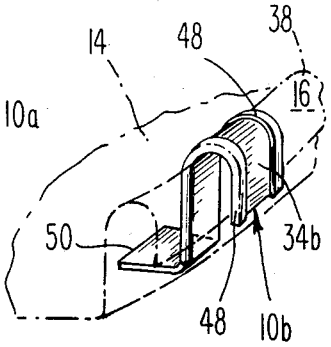

In FIG. 6*b*, lug 10*b* is shown with shoulders 48 disposed along its outer edges. Shoulders 48 may be presented by lug 10*b* in the presence of horizontal flap 50 for securing lug 10*b* to central body 14 or in the absence of horizontal flap 50. Furthermore, outer band 34*b* having shoulders 48, may extend downwardly a portion of the distance along outer rim 40 to edge 42, the entire length to edge 42, or beyond edge 42.

Figure 6C:
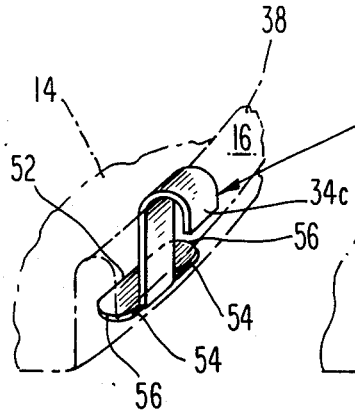

Reinforcing lug 10*c* in FIG. 6*c* is shown with horizontal flap 52. Rounded extensions 54 of horizontal portion 52 extend outwardly beyond the width of reinforcing lug 10*c* in which edges 56 of rounded extensions 54 are arcuate.

Figure 6D:
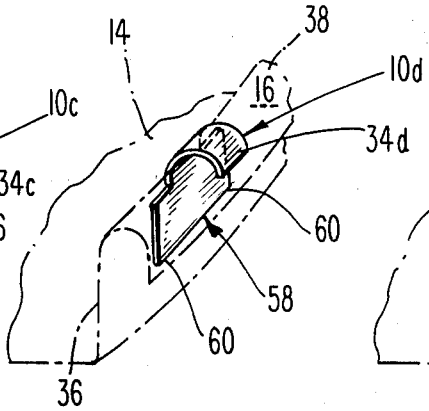

In FIG. 6*d*, reinforcing lug 10*d* is shown having vertical flap 58 which may be secured to wall 36 of lip 16. Horizontal flap 58 is shown with rectangular extensions 60 which may be welded to wall 36. However, extensions 60 need not be present and when present may be rounded in a manner similar to that described for rounded extensions 54 of horizontal flap 52. Both horizontal flap 52 of lug 10*c* and vertical flap 58 of lug 10*d* may be used with any length of outer band 34*c* or outer band 34*d*.

Figure 6E:
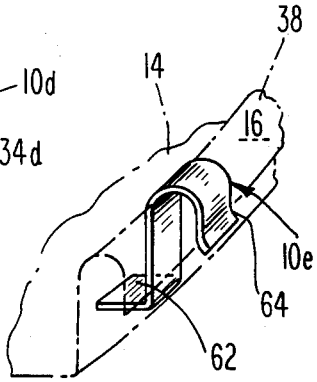

Referring now to FIG. 6*e*, reinforcing lug 10*e* is shown with arcuate flange 64 and horizontal flap 62. Arcuate flange 64 may also be formed on lug 10 in combination with other horizontal flaps as previously described or in the absence of horizontal flaps.

Figure 6F:
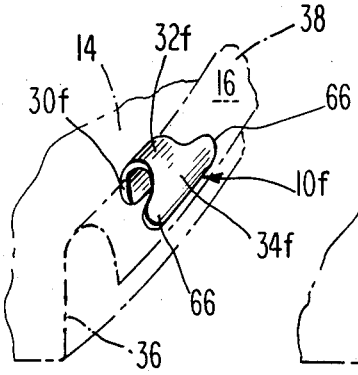

Reinforcing lug 10*f*, shown in FIG. 6*f*, includes inner band 30*f* extending downwardly from arcuate edge 32*f* along wall 36. Outer band 34*f* extends downwardly from arcuate edge 32 along outer rim 40. Arcuate flaps 66 extend outwardly from band 34*f*.

Figure 6G:
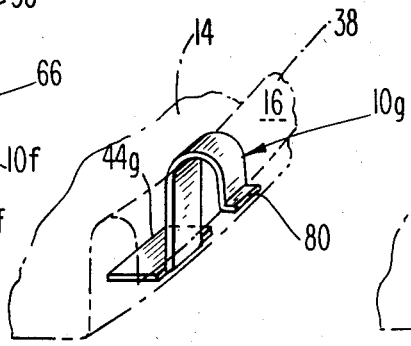

In FIG. 6*g*, there is shown an embodiment of reinforcing lug 10*g* including horizontal flap 44*g* and substantially horizontal flange 80. Flanges 64,80 may depend from outer band 34 for any of the alternate embodiments of reinforcing lug 10 described herein.

Figure 6H:
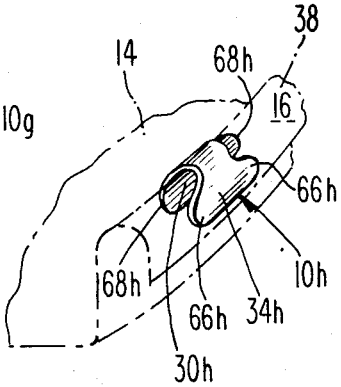

Referring now to FIG. 6*h*, reinforcing lug 10*h* is shown with outer band 34*h* and arcuate flaps 66*h* as previously described for outer band 34 and arcuate flaps 66 of reinforcing lug 10*f*. Flaps 68 extend outwardly from inner band 30 of lug 10*h*. *It will be understood that reinforcing lug 10 may be fastened to lip 16 using any method which rigidly secures lug 10. For example, elliptical projection welding electrodes (not shown) may be pressed against lug 10, overlapping onto lip 16, thereby projection welding lug 10 to lip 16. The elliptical electrodes may have a width of approximatly three-quarters of an inch and a length of approximately three-eighths of an inch. The three-quarter inch dimension may run parallel to edge 42 and extend over both edges of U-shaped arch curvature 32 of lug 10 onto arcuate edge 38 of lip 16. A second such projection weld may be performed in the region of inner band 30 and wall 36 and a third weld may be performed in the region of outer band 34 and outer rim 40. The welds are thus parallel to each other.*

Additionally, lug 10 may be fastened to lip 16 using an induction oven or induction coil. In this method brazing powder may be placed between lug 10 and lip 16 and the assembly subjected to a temperature of approximately 550–600 degrees Farenheit by induction heating. Lug 10 may also be fastened by cold welding using a laser.

It is claimed:

1. A drum lid with a lip having an outer circumference and adapted to be clamped to a drum by a closing ring for sealing the drum comprising a metal reinforcing lug rigidly secured to the exterior of the lip, the metal lug of transverse dimension extending only a minor section of the outer circumference of the lip.

2. The drum lid of claim 1 in which the metal reinforcing lug is of sufficient width to prevent dimpling of the drum lid.

3. The drum lid of claim 1 in which the metal reinforcing lug is of transverse dimension sufficient to be disposed between ends of the closing ring.

4. The drum lid of claim 1 in which the reinforcing lug is welded to the exterior of the lip.

* * * * *